US005357577A

United States Patent [19]

Waji et al.

[11] Patent Number: 5,357,577

[45] Date of Patent: Oct. 18, 1994

[54] VACUUM TUBE MICROPHONE APPARATUS

[75] Inventors: Tomohiro Waji; Kazumasa Takahashi; Satoshi Yamazaki, all of Kanagawa; Kiichi Yoshida, Saitama; Osamu Kohno; Tohru Enokuma, both of Tokyo; Eiichi Tanaka, Kanagawa, all of Japan

[73] Assignee: Sony Corporation, Tokyo, Japan

[21] Appl. No.: 953,124

[22] Filed: Sep. 28, 1992

[30] Foreign Application Priority Data

Sep. 30, 1991 [JP] Japan ..... 3-251672

[51] Int. Cl.[5] ..... H04R 3/00

[52] U.S. Cl. ..... 381/122; 381/115; 381/114; 381/113; 381/112; 381/111; 361/704

[58] Field of Search ..... 381/115, 114, 113, 112, 381/111, 122; 62/3.2, 3.7, 259.2; 361/423, 382, 385

[56] References Cited

U.S. PATENT DOCUMENTS

| | | | |
|---|---|---|---|
| 1,988,001 | 1/1935 | Flanders | 381/113 |
| 2,920,140 | 1/1960 | Morgan | 381/113 |
| 3,188,240 | 1/1965 | Lee et al. | 62/3.2 |
| 4,120,019 | 10/1978 | Arii et al. | 361/385 |

FOREIGN PATENT DOCUMENTS

| | | | |
|---|---|---|---|
| 01-32699 | 2/1989 | Japan | 361/385 |

*Primary Examiner*—Curtis Kuntz
*Assistant Examiner*—Mark D. Kelly
*Attorney, Agent, or Firm*—Lewis H. Eslinger; Jay H. Maioli

[57] ABSTRACT

A microphone apparatus including a vacuum-tube amplifier amplifying an electric signal converted from an acoustic signal includes a thermo-ionic cooling element having two surfaces, in which a first surface is in contact with the vacuum-tube amplifier for absorbing the heat generated from the vacuum-tube amplifier and the absorbed heat is radiated to the exterior from the second surface.

11 Claims, 11 Drawing Sheets

VACUUM TUBE MICROPHONE APPARATUS

FIELD OF THE INVENTION

This invention relates generally to a microphone apparatus and, more particularly, to a microphone using a vacuum tube in an amplifier circuit for amplifying an electric signal into which a sound signal has been converted.

DESCRIPTION OF THE BACKGROUND

Microphone apparatus of the type including vacuum tubes used for converting a sound signal to an electric signal have been produced and used in the past. In most of these microphones the vacuum tubes have now been replaced with semiconductors, however, such vacuum-tube microphones are still used to provide a delicate tone quality different than the tone quality provided by semiconductor microphones.

One problem that occurs with the vacuum-tube type microphone apparatus is that the vacuum tube heats the interior of the microphone housing, so that the temperatures of the electric parts contained in the microphone housing are increased. Because these electric parts all have different specific heats, the electric parts exhibit different temperatures as they are being heated to a steady-state temperature. For this reason, the temperature dependant characteristics of the electric parts cannot be stabilized until the temperatures of all of the electric parts are stabilized.

Another problem is that during vacuum tube operation, thermions are emitted from the cathode with increasing plate temperature because of plate losses and heat radiation from the heater. The potential between the plate and the cathode accelerates the thermions toward the plate, and the accelerated thermions collide with the plate to emit secondary electrons so that the space between the grid and the plate becomes filled with stray electrons. Such stray electrons impede the electron flow from the cathode toward the plate and result in noise in the plate current. The stray electrons flow toward the wall surface of the glass envelope of the vacuum tube and thereby charge the glass envelope. When the electrons are further attracted, gases are emitted to reduce the extent of vacuum within the glass envelope of the vacuum tube, so as to impede the electron flow from the cathode toward the plate. As a result, noise is introduced onto the plate current.

A third problem is that the vacuum tube is subject to thermal failure and/or mechanical breakage, because the glass envelope is heated to such a high temperature.

OBJECT AND SUMMARY OF THE INVENTION

Accordingly, it is an object of the present invention to provide a vacuum tube microphone apparatus that can overcome the above-noted defects inherent in the prior art.

It is another object of the present invention to provide an improved vacuum tube microphone apparatus that can operate in a stable manner over a very long period of time.

In accordance with an aspect of the present invention, a microphone apparatus is formed by a transducer for converting a sound signal into an electrical signal, a vacuum-tube amplifier connected to the transducer for amplifying the electric signal, and a thermo-ionic cooling element for absorbing heat generated by the vacuum-tube amplifier. The thermo-ionic cooling element has a first surface for absorbing the heat and a second surface for radiating the heat. The first surface is in contact with the vacuum-tube amplifier. The microphone apparatus also includes a heat conducting device in contact with the second surface of the thermo-ionic cooling element for conducting away the heat radiated by the second surface and fins mounted on the heat conducting device for radiating the heat.

In another aspect of the invention, there is provided a microphone apparatus including a transducer for converting a sound signal to an electrical signal, a vacuum-tube amplifier connected to the transducer output for amplifying the electrical signal, and a thermo-ionic cooling element for absorbing the heat generated by the vacuum-tube amplifier. The thermo-ionic cooling element has a first surface for absorbing the heat and a second surface for radiating the heat. The first surface is in contact with the vacuum-tube amplifier.

Also according to this invention there is provided a microphone apparatus having a transducer for converting a sound signal to an electrical signal, a vacuum-tube amplifier connected to the transducer for amplifying the electrical signal and a thermo-ionic cooling element for absorbing heat generated by the vacuum-tube amplifier. The thermo-ionic cooling element has a first surface for absorbing heat and a second surface for radiating heat. The first surface is in contact with the vacuum-tube amplifier. The microphone apparatus also includes fins in contact with the second surface of the thermo-ionic cooling element for radiating the heat radiated by the second surface.

The invention also provides a microphone apparatus including a first housing having a device for converting a sound signal to an electrical signal and a second housing having a vacuum-tube amplifier for amplifying the electrical signal, with a thermo-ionic cooling element for absorbing heat generated by the vacuum-tube amplifier. The thermo-ionic cooling element has a first surface for absorbing heat and a second surface for radiating heat. The first surface is in contact with the vacuum-tube amplifier and the first and second housings are engaged with each other. The microphone apparatus also includes a heat conducting device in contact with the second surface of the thermo-ionic cooling element for conducting the heat radiated by the second surface, fins mounted on the heat conducting device for radiating the heat, and an element for absorbing moisture that has condensed on the outer surface of the second housing. The moisture absorbing element is wrapped around the outer surface of the second housing.

In another aspect of the present invention, there is provided a microphone apparatus with a housing having a device for converting a sound signal to an electric signal, a vacuum-tube amplifier for amplifying the electric signal, and a holding device in contact with the inner surface of the housing for covering the outer surface of the vacuum tube, so as to hold the vacuum tube at a predetermined position. The holding device absorbs heat generated by the vacuum-tube amplifier, and the holding device conducts the heat to the housing and radiates the heat away.

In still another aspect of the present invention, there is provided a microphone apparatus comprising a housing having a device for converting a sound signal to an electrical signal. The housing includes first and second housing elements, and the first housing element has a first portion of a first thickness and a second portion of a second thickness, less than the first thickness. The second housing element has a third portion of a third thickness and fourth portion of a fourth thickness less than the third thickness so that the second portion of the first housing element can be engaged with the fourth portion of the second housing element.

The manner in which the above and other objects are accomplished by the present invention will become obvious from the following detailed description to be read in connection with the accompanying drawings, in which like reference numerals represent the same or: similar elements.

DETAILED DESCRIPTION OF PREFERRED EMBODIMENTS

Figure 1:
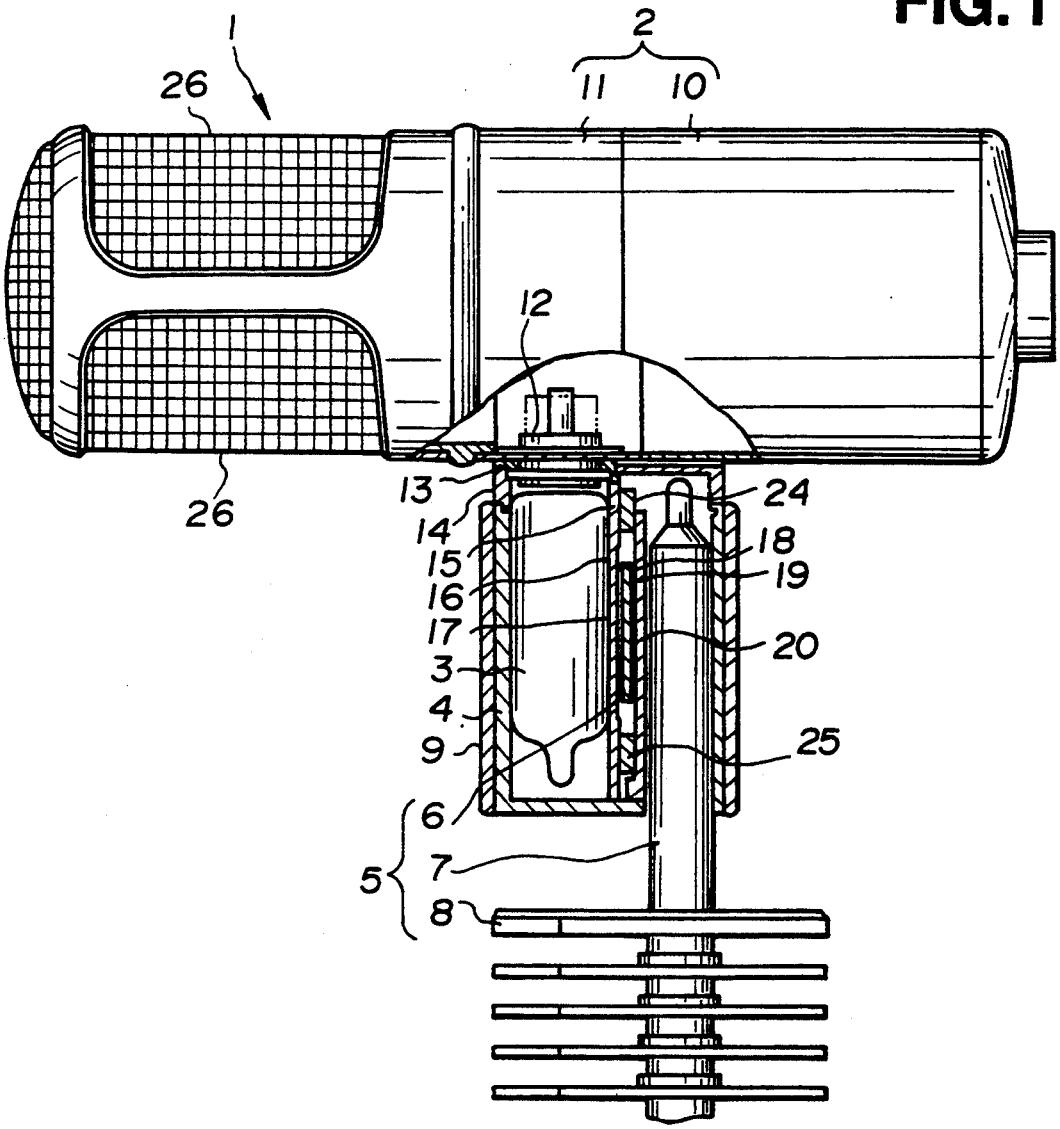
FIG. 1 is a side elevational view in partial cross-section of a microphone apparatus in accordance with an embodiment of the present invention.

Referring to FIGS. 1–3, 6, and ;there is shown an embodiment of a microphone apparatus 1 in accordance with an embodiment of the present invention in which a microphone housing 2 contains a microphone capsule (not shown). The microphone capsule comprises the acoustic-electric transducer that turns sound waves into electrical signals. A vacuum tube cover 4 is mounted on the peripheral surface of the microphone housing 2 and contains a vacuum tube 3. The microphone apparatus also includes a cooling unit 5 for cooling the vacuum tube 3. The cooling unit 5 includes a thermo-ionic cooling element 6 that may be in the form of a so-called Peltier element and has a heat absorbing surface for absorbing the heat generated from the vacuum tube 3 and a heat radiating surface for radiating the absorbed heat. The cooling unit 5 also includes a heat pipe 7 having a predetermined thermal conductivity. The heat pipe 7 has one end portion thereof placed adjacent the heat radiating surface of the thermo-ionic cooling element 6. The heat pipe 7 extends outwardly from the tube cover 4 and has a number of heat radiating fins 8 secured onto the other end portion thereof. The heat radiating fins 8 are spaced apart from the microphone housing 2 and also from the tube cover 4. A moisture or condensation absorbing element 9 is mounted so as to be wrapped around the outer peripheral surface of the tube cover 4.

The microphone housing 2 has a cylindrical main-grip portion 10 and cylindrical sub-grip portion 11. The sub-grip portion 11 has a socket 12 for mounting the vacuum tube 3 outside of the microphone housing 2. The tube cover 4 is mounted on the sub grip 11 through a heat insulating spacer 13, a first cooling attachment 14, and a second cooling attachment 15. The second cooling attachment 15 has one side surface thereof in contact with the surface of the glass envelope of the vacuum tube 3 through a silicone compound 16 that has a high thermal conductivity. The other side surface of the second cooling attachment 15 is in contact through a silicone compound 17 with the thermo-ionic cooling element 6. The heat absorbing surface of the thermo-ionic cooling element 6 is in contact with the wall surface of the glass envelope of the vacuum tube 3 through the silicone compound 17, the second cooling attachment 15, and the silicone compound 16. The heat radiating surface of the thermo-ionic cooling element 6 is in contact through the silicone compound 18 with the outer surface of a cylindrical pipe base 19, which is made of a material having a high thermal conductivity. The inner surface of the cylindrical pipe base 19 is in contact through a silicone compound 20 with the heat pipe 7.

The heat pipe 7 may be in the form of a metal pipe provided on its inner wall with a capillary structure. The metal pipe has its interior evacuated and charged with a small amount of a working fluid, such as water, fluoromethane, or the like. One end portion of the heat pipe 7 is inserted into the pipe base 19 and in contact with the heat radiating surface of the thermo-ionic cooling element 6 through the silicone compound 20, the pipe base 19, and the silicone compound 18. The heat pipe 7 extends outward from the pipe base 19 and has a number of heat radiating fins 8 secured on the other end portion thereof. The heat radiating fins 8 are held out of contact with the microphone housing 2 and the tube cover 4.

Figure 6:
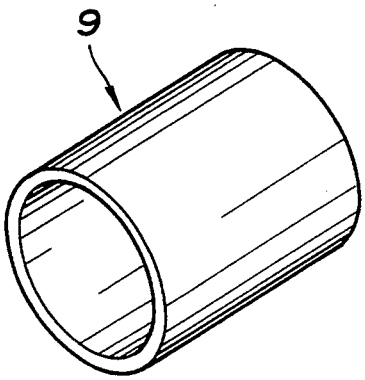
FIG. 6 is a perspective view of an embodiment of a moisture absorbing element used in the microphone apparatus of FIG. 1.
Figure 7:
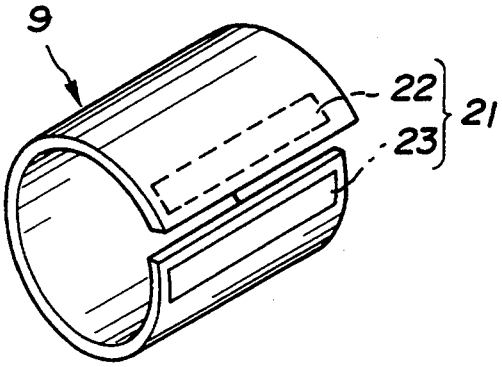
FIG. 7 is a perspective view of another embodiment of a moisture absorbing element used in the microphone apparatus of FIG. 1.

The moisture absorbing element 9 can be made of either a woven or nonwoven fabric having good water absorbing capacity in a cylindrical form, as shown in FIG. 6, or in belt form, as in FIG. 7, to cover the whole area of the outer peripheral surface of the tube cover 4. FIG. 6 shows the cylindrical moisture absorbing element 9 having an appropriate flexibility so that it can be fitted around the outer peripheral surface of the tube cover 4. In FIG. 7, a fastener 21 has a hook portion 22 and a loop portion 23 for fastening the moisture absorbing member 9 around the outer peripheral surface of the tube cover 4.

Figure 2:
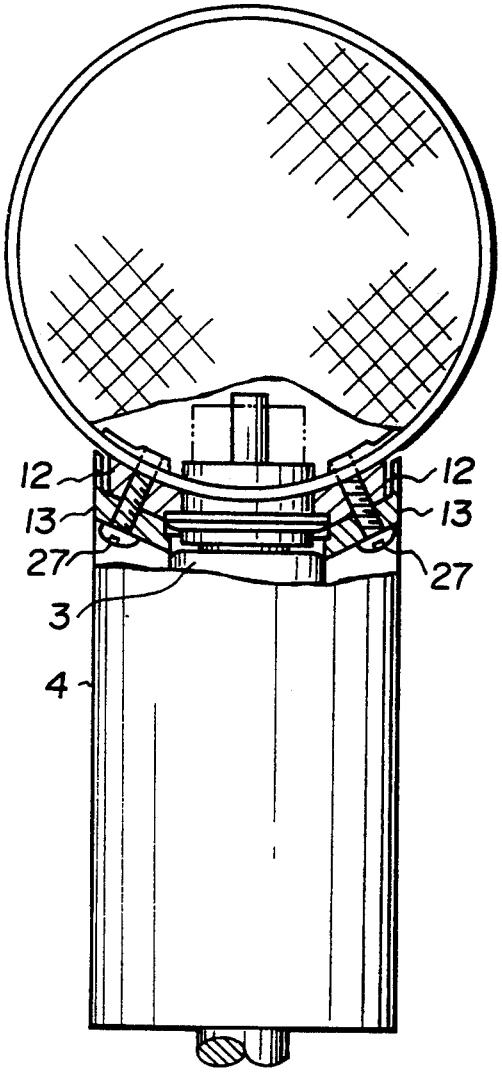
FIG. 2 is an elevational view in cross section of the microphone apparatus of FIG. 1.
Figure 3:
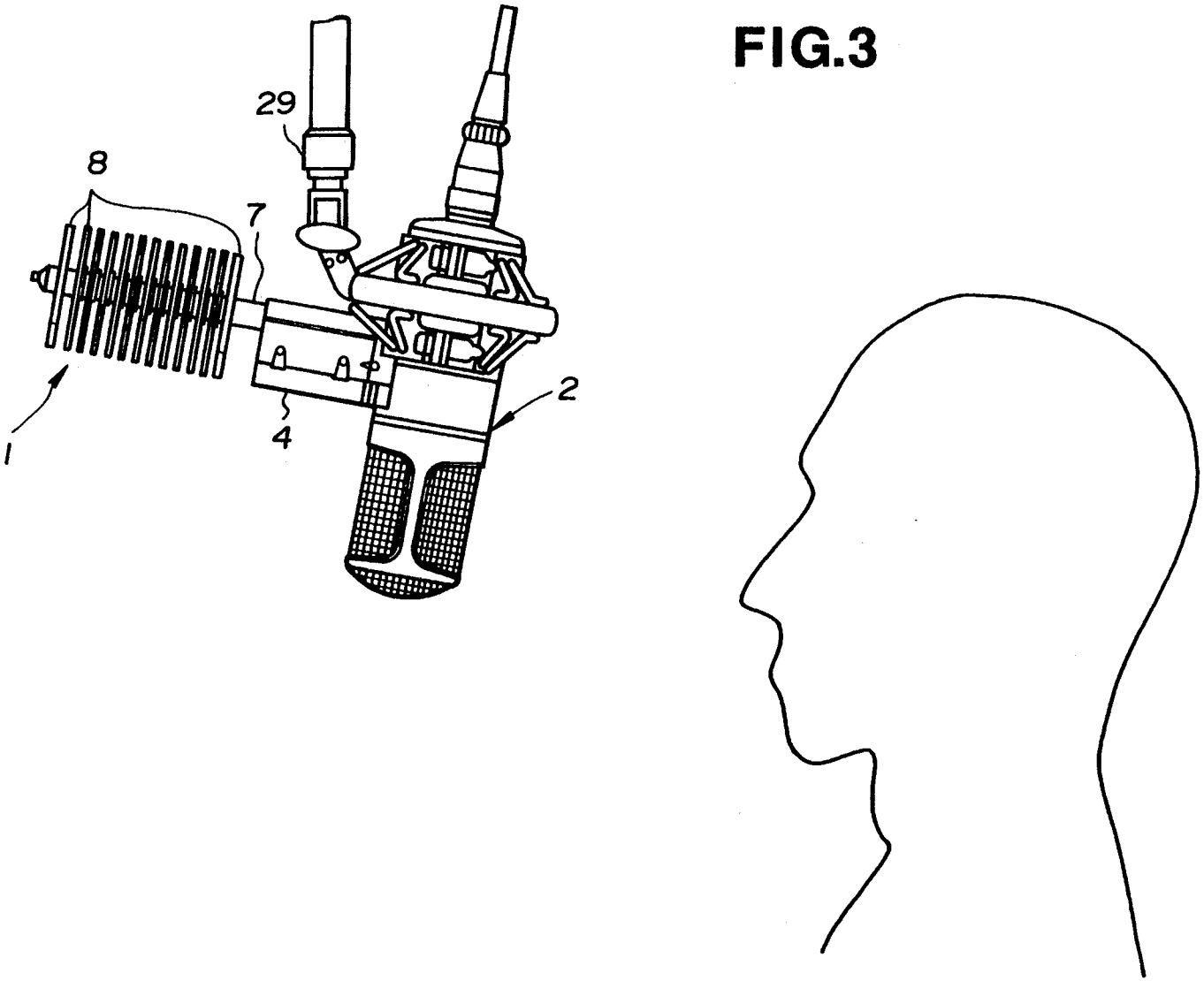
FIG. 3 is a side elevational view showing a portion of the microphone apparatus of FIG. 1.

In FIG. 1, heat insulating spacers 24, 25 are provided between the second cooling attachment 15 and the pipe base 19. In FIG. 2, bolts 27 are used in fixing the cooling attachment 14 to the sub-grip portion 11. A suspended microphone holder 29 of FIG. 3 is used to support the microphone apparatus 1 at an inclined position where the heat pipe 7 is directed somewhat upwardly, as shown in FIG. 3.

The operation of the microphone apparatus is as follows. When the acoustic/electric signal system is powered and the temperature of the glass envelope wall surface of the vacuum tube 3 increases, the heat on the envelope wall surface is transmitted through the silicone compound 16, the second cooling attachment 15, and the silicone compound 17 to the heat absorbing surface of the thermo-ionic cooling element 6 where it is absorbed. The absorbed heat is then radiated from the heat radiating surface of the thermo-ionic cooling element 6 and, transmitted through the silicone compound 18, the pipe base 19, and the silicone compound 20 to heat the heat pipe 7. When the heat pipe 7 is heated, the working fluid is evaporated and flows upward at a high speed through the heat pipe 7 toward the heat radiating fins 8 so that the shifted heat can be radiated to the exterior through the heat radiating fins 8. Once the heat is radiated, the working fluid is liquified again. The liquefied working fluid then flows downwardly through the heat pipe 7 toward the heat radiating surface where the heat causes it to be vaporized again. The working fluid is vaporized and liquified repeatedly to radiate the heat from the glass envelope surface of the vacuum tube 3 to the exterior through the thermo-ionic cooling element 6, the heat pipe 7, and the heat radiating fins 8, so as to cool the vacuum tube 3.

If the heat radiating fins 8 are designed to satisfy the condition where the heat pipe 7 has a surface temperature $T_P$ when the ambient temperature is $T_a$, the following equation will be established on an assumption that the cooling attachments and the silicone compounds have very large thermal conductivities:

$$T_D = T_P - (T_H - T_C)$$

where $T_D$ is the temperature of the surface of the glass envelope of the vacuum tube 3, $T_C$ is the temperature of the heat absorbing surface of the thermo-ionic cooling element 6, and $T_H$ is the temperature of the heat radiating surface of the thermo-ionic cooling element 6. The actual temperatures measured for the microphone apparatus were $T_D = 12°$ C., $T_P = 42°$ C., $T_H - T_C = 30°$ C., and $T_a = 25°$ C. The actual temperatures measured for the conventional microphone apparatus where the heat is radiated naturally from the vacuum tube were $T_D = 65°$ C. and $T_a = 25°$ C. Therefore, it can be seen that the invention can reduce the temperature of the glass envelope wall surface of the vacuum tube by 53 ° C.

When the heat absorbing surface of the thermo-ionic cooling element 6 absorbs the heat from the vacuum tube 3, it also cools the tube cover 4. If the water vapor of the air in the atmosphere contacts the cooled tube cover, condensation will form on the tube cover 4. The outer peripheral surface of the tube cover 4 is covered with the moisture absorbing element 9 made of a heat insulating woven or nonwoven fabric. This material is effective to suppress condensation on the tube cover 4. Even though the water vapor is condensed on the tube cover 4, the moisture absorbing element 9 absorbs the moisture to prevent it from entering the tube cover 4 and/or the microphone housing 2. The water absorbed into the moisture absorbing element 9 is diffused over the entire area thereof by capillary action, and is then vaporized by heat from the heat radiating surface of the thermo-ionic cooling element 6.

Figure 4:
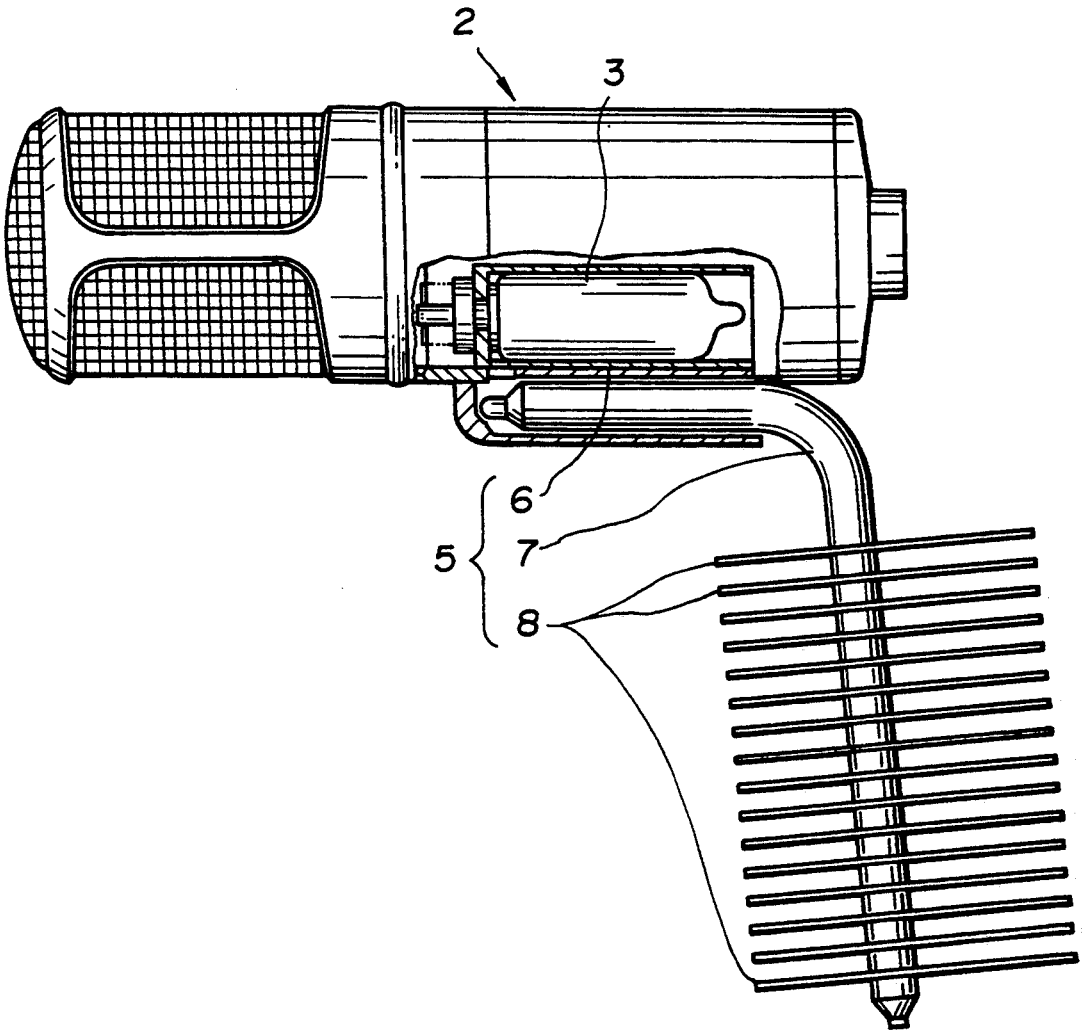
FIG. 4 is an elevational view in partial cross-section of a microphone apparatus according to another embodiment of the present invention.
Figure 5:
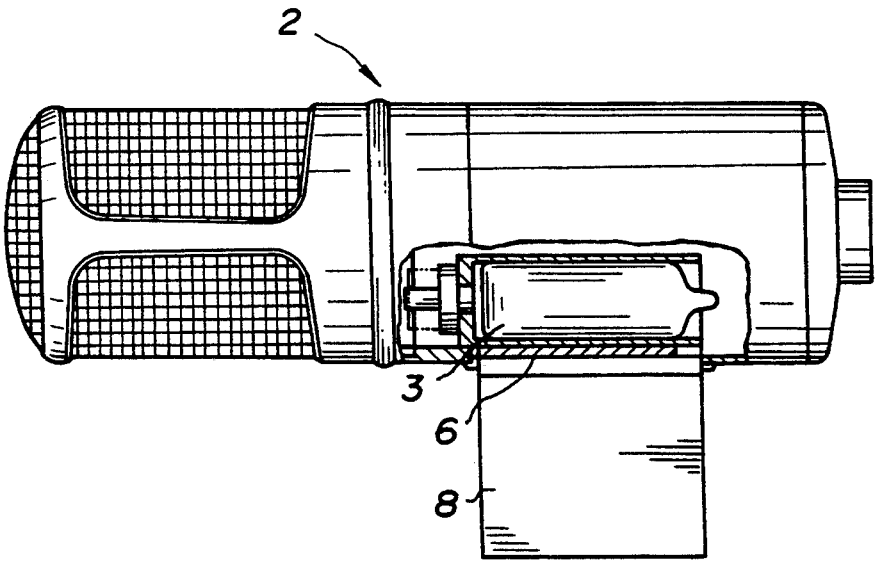
FIG. 5 is an elevational view in partial cross section of a microphone apparatus according to still another embodiment of the present invention.

Although the thermo-ionic cooling element 6 is used to absorb and radiate the heat from the surface of the vacuum tube 3, it is to be understood that the cooling unit may be arranged so that one end portion of the heat pipe 7 directly contacts the glass envelope wall surface of the vacuum tube 3 with the thermo-ionic cooling element being eliminated. Furthermore, although the cooling unit 5, which includes the thermo-ionic cooling element 6, the heat pipe 7 and the heat radiating fins 8, is placed outside the microphone housing 2, it is to be understood that the vacuum tube 3 and the thermo-ionic cooling element 6 could be placed inside the microphone housing 2 with the heat pipe 7 and the heat radiating fins 8 being placed outside the microphone housing 2, as shown in FIG. 4. One way to reduce the size of the microphone apparatus is by connecting the thermo-ionic cooling element 6 directly to the heat radiating fins 8 with the heat pipe 7 being removed, as shown in FIG. 5. Another way to reduce the size of the microphone apparatus is to eliminate the heat radiating fins 8 and to radiate the heat directly from the heat radiating surface of the thermo-ionic cooling element 6.

Turning now to FIGS. 8 to 11, there is shown a second embodiment of the microphone apparatus of the invention, in which the microphone 31 includes a housing or sleeve 32 that contains a vacuum tube 33 therein. The vacuum tube 33 is used in an acoustic/electric signal converting system that converts a sound or acoustic signal =! into an electrical signal. A socket 34 is provided in the housing 32 for mounting and making electrical connections to the vacuum tube 33. The vacuum tube 33 has its outer peripheral surface covered with a heat conductive resilient member 35 that is in partial contact with the inner surface of the housing 32. The housing 32 is made of an aluminum alloy having a high thermal conductivity in a cylindrical form that is provided at one end with a mesh Windscreen 36. The housing 32 contains a microphone capsule (not shown) adjacent to the windscreen 36. The microphone capsule converts sound pressure into an electrical signal that is amplified by an amplifier including the vacuum tube 33. The vacuum tube socket 34 is mounted on a socket holder 38 by bolts 37. The socket holder 38 is mounted through a tubular buffer member 39 to a metal holder support member 40. The holder support member 40 is mounted on a main support plate 42 by bolts 41, and the support plate 42 extends between a pair of chassis 43 and 44 mounted in the housing 32.

Figure 8:
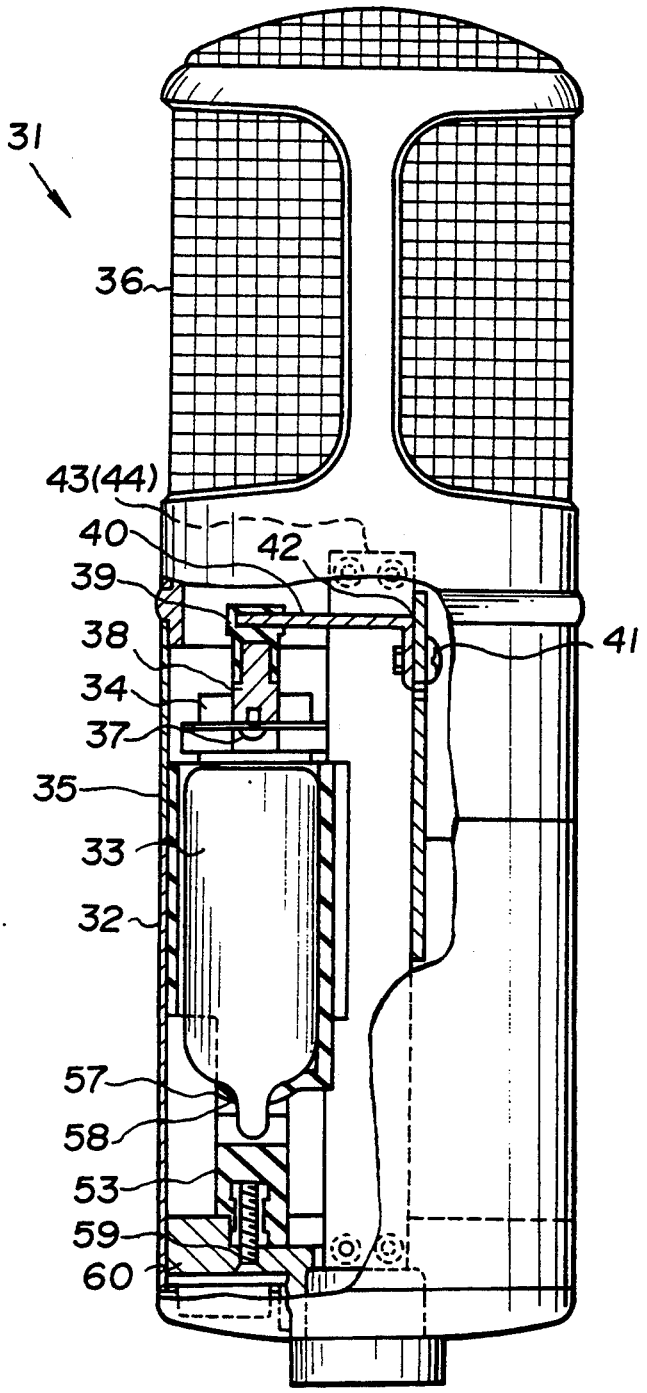
FIG. 8 is a side elevational view in partial cross section of a microphone apparatus according to yet another embodiment of the present invention.
Figure 9:
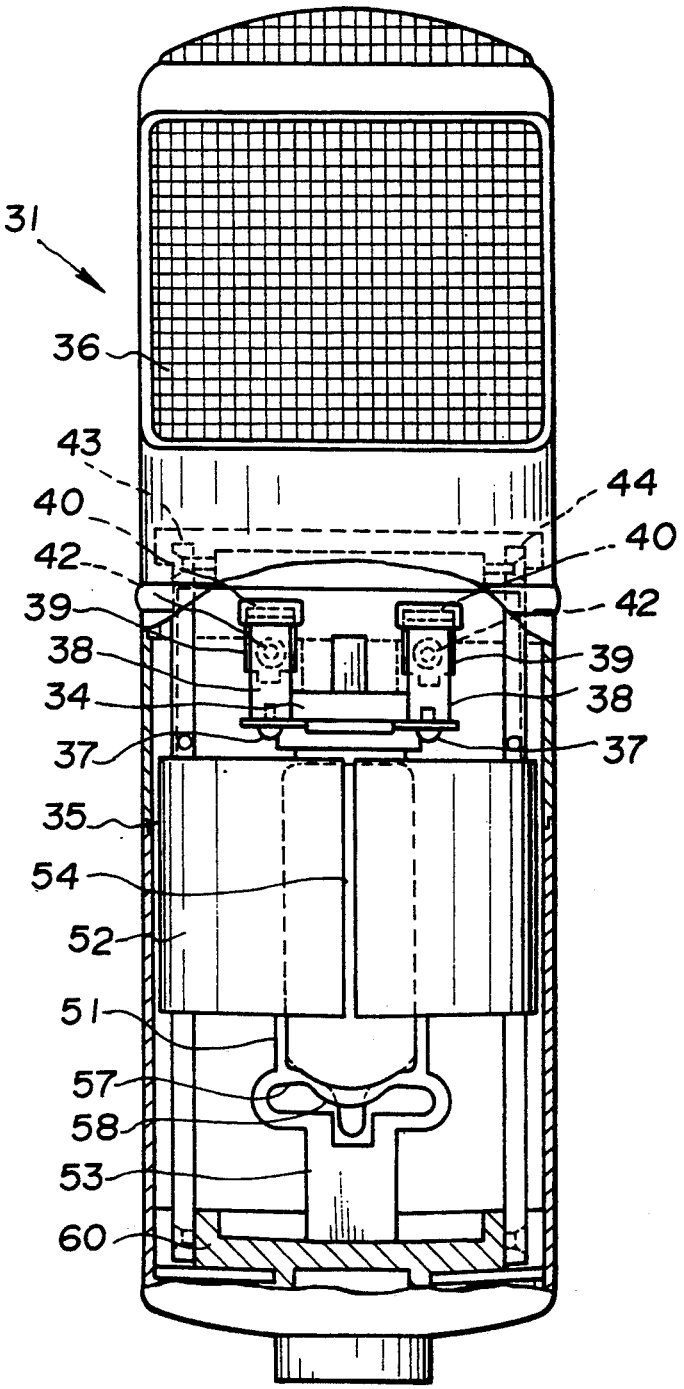
FIG. 9 is an elevational view in partial cross section showing the microphone apparatus of FIG. 8.
Figure 10:
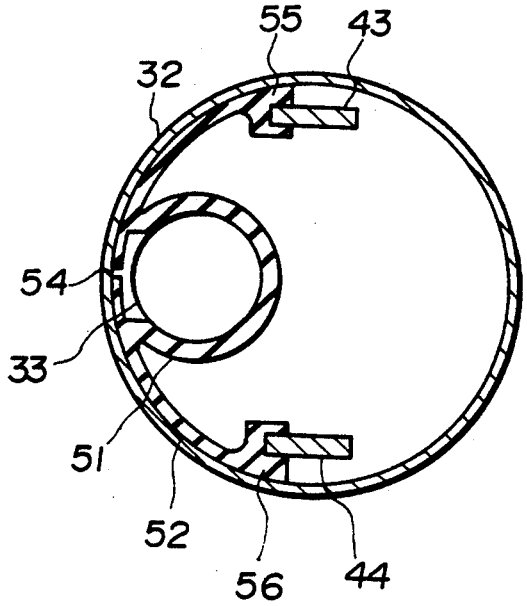
FIG. 10 is a transverse sectional view of a portion of the microphone apparatus of FIG. 8.
Figure 11:
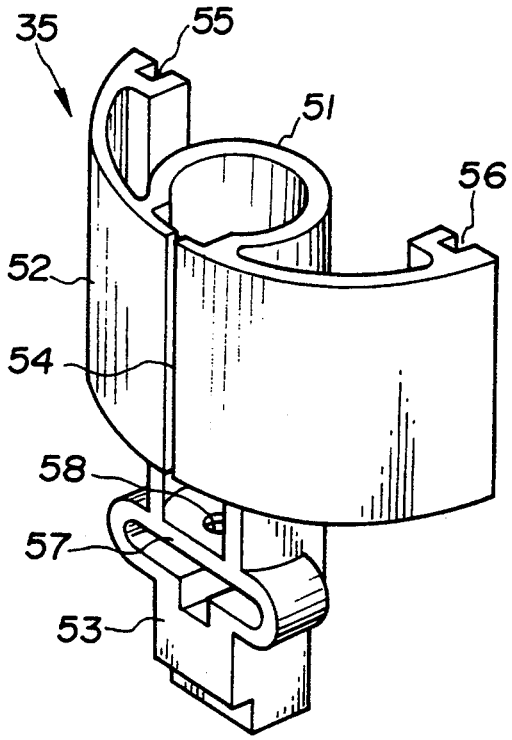
FIG. 11 is perspective view of the heat conductive resilient member used in the microphone apparatus of FIG. 8.

The heat conductive resilient member 35 is made of rubber, plastic or the like having good resilient properties, good heat resistance, a high heat conductivity, and containing no sulfur, which has an undesirable effect on the silvered portion of the vacuum tube socket 34. As shown in FIGS. 10 and 11, the heat conductive resilient member 35 has a cylindrical portion 51 that covers the outer peripheral surface of the vacuum tube 33 when the vacuum tube 33 is placed in position. Member 35 also includes a semi-circular contact piece 52 having an inner surface connected to the cylindrical portion 51 and an outer surface that is curved so that it can be held in surface contact with the inner peripheral surface of the housing 31 and a fixed portion 53 extending from the lower end of the cylindrical portion 51. The cylindrical portion 51 and the semi-circular contact piece 52 are divided by a parting line 54. The semi-circular contact piece 52 is formed at its opposite ends with grooves 55 and 56 for engagement with the respective chassis 43 and 44. The fixed portion 53 has a hollow support section 57 that supports the top of the vacuum tube 33 in a resilient manner. The hollow support section 57 has a center hole 58 for positioning the head of the vacuum tube 33 in place. As best shown in FIG. 10, the heat conductive resilient member 35 is placed in the housing 32 with the cylindrical portion 51 surrounding the outer peripheral surface of the vacuum tube 33. Cylindrical portion 51 is held in contact with the inner surface of the housing 32, and the grooves 55 and 56 engage the respective chassis 43 and 44. The fixed portion 53 is secured to a connector sleeve 60 by bolts 59, as shown in FIG. 8.

In the operation of this embodiment, the vacuum tube 33 is supported by the socket 34 and the heat conductive resilient member 35 in the housing 32. The vacuum tube 33 is cooled by transmitting the heat generated by it through the cylindrical portion 51 and the contact piece 52 to the housing 32 and radiating the transmitted heat to the exterior from the outer surface of the housing 32. Because the socket 34 is mounted on the housing 32 using the tubular buffer member 39, it is possible to minimize the impacts and/or vibrations transmitted through the socket 34 to the vacuum tube 33. The heat conductive resilient member 35 is also effective in protecting the vacuum tube 33 from impacts and/or vibrations. It is to be understood that the heat conductive resilient member 35 is not limited to the configuration shown and it can assume any other shape, so long as it can cover the outer peripheral wall of the vacuum tube 33, protect the vacuum tube 33, absorb the heat from the vacuum tube 33, and transmit the absorbed heat to the housing 32.

Figure 12:
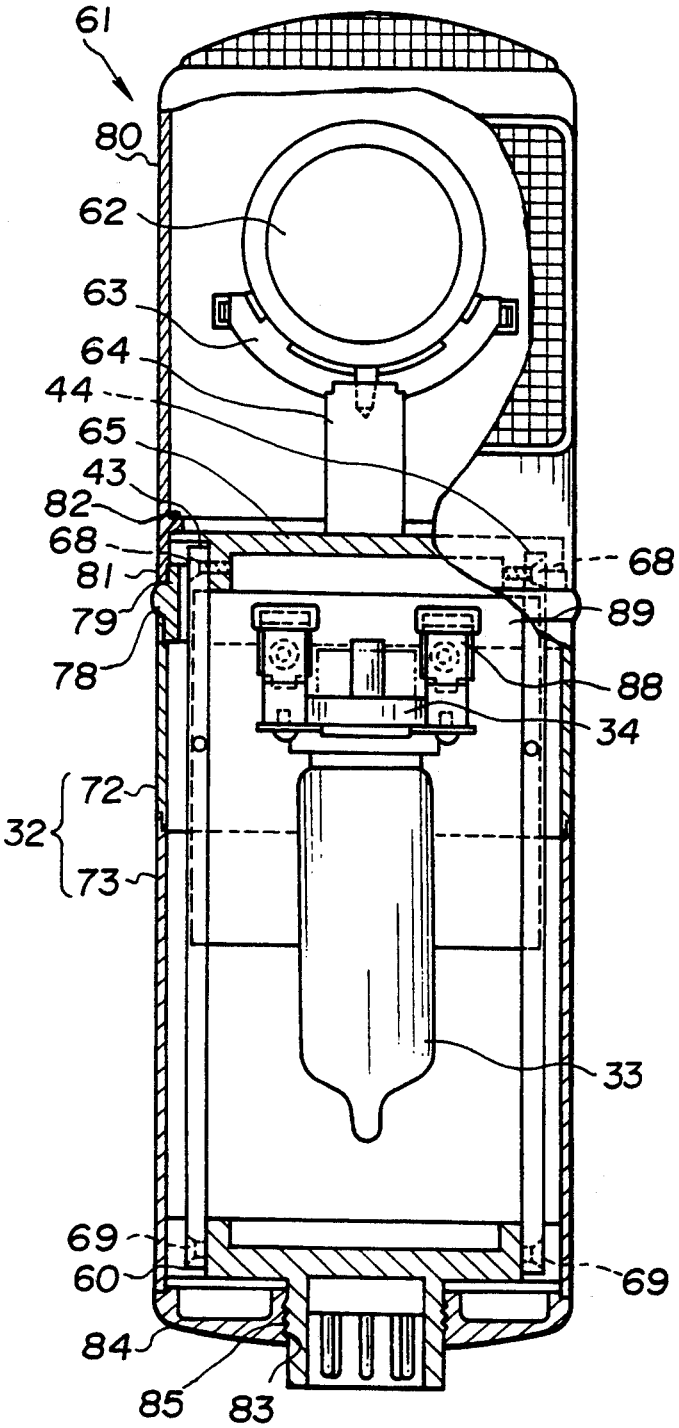
FIG. 12 is an elevational view in partial cross section of a further embodiment of a microphone apparatus according to the present invention.
Figure 13:
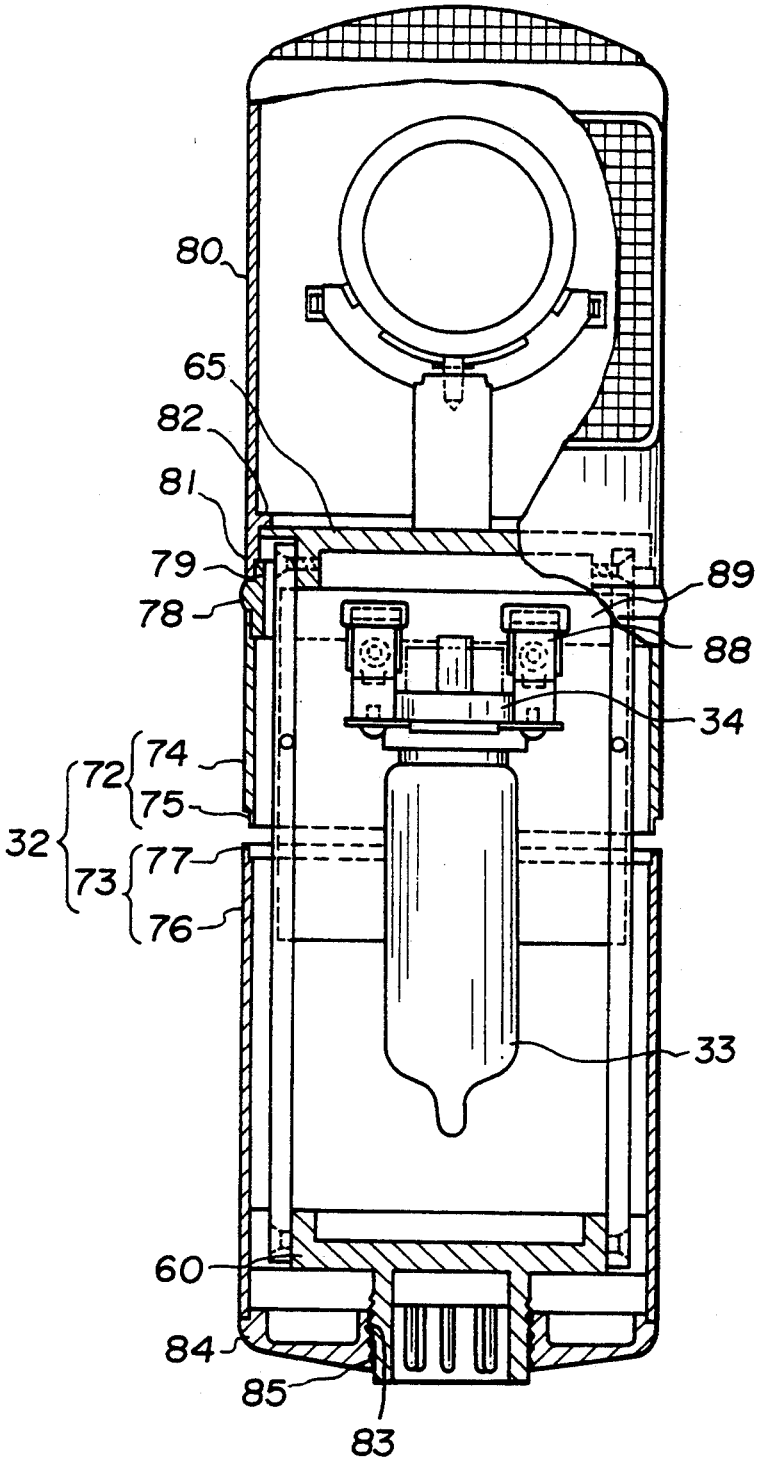
FIG. 13 is an elevational view in partial cross section showing the microphone apparatus of FIG. 12 with the first and second housing sections being separated.
Figure 14:
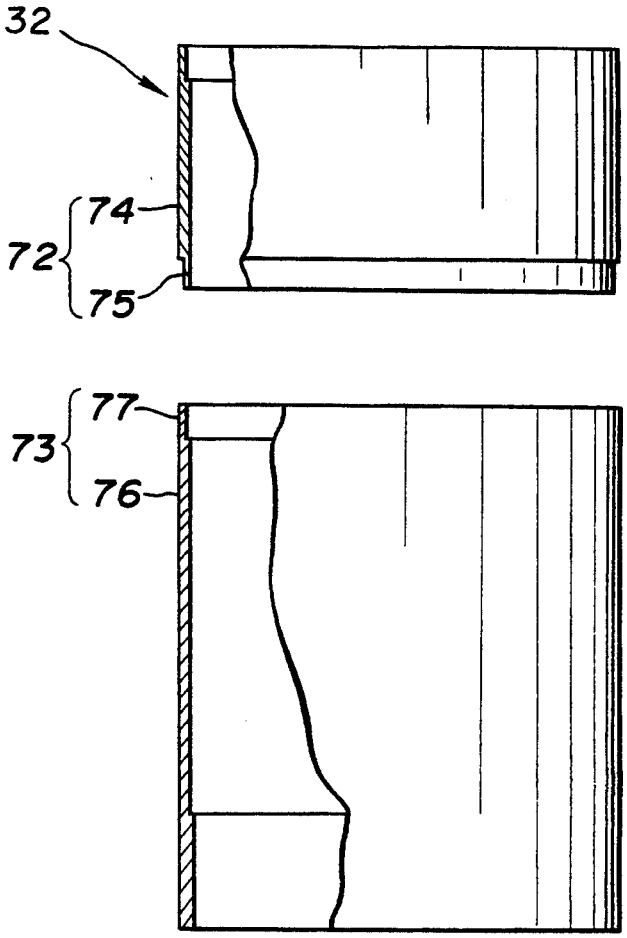
FIG. 14 is a fragmentary sectional view showing the first and second housing sections used in the microphone apparatus of FIG. 12.

Referring to FIGS. 12 to 14, there is shown a third embodiment of the microphone apparatus of the invention, in which a microphone 61 includes a microphone capsule 62 contained in a cylindrical housing. The microphone capsule 62 is mounted through a capsule holder 63, a capsule suspension 64, and a capsule base 65 to the upper ends of left and right chassis 43 and 44 by means of bolts 68. A connector sleeve 60 is mounted to the lower ends of the left and right chassis 43 and 44 by means of bolts 69. The cylindrical housing 32 includes first and second housing sections 72 and 73. As best shown in FIGS. 13 and 14, the first housing section 72 has a thick wall portion 74 having a reduced wall thickness portion 75 with a thickness less than the thick wall portion. The second housing section 73 has a thick wall portion 76 having a thickness substantially equal to the thick wall portion 74 and a thin wall portion 77 having a thickness substantially equal to the reduced wall thickness of the portion 75. The thin portion 77 of the second housing section 73 is fitted around the thin portion 75 of the first housing section 72 to combine the first and second housing sections 72 and 73. A lock ring 78 is rotatably mounted on the upper end of the cylindrical housing 71 and has an externally threaded upper portion 79 that threadedly engages with an internally threaded lower end portion 81 of a cage 80. A ring-shaped flange 82 is formed on an inner peripheral surface of the cage 80 for engagement with the upper surface of the capsule base 65. At the bottom of the cylindrical housing 32 a connection sleeve 60 has an externally threaded portion 83 that is threadedly engaged with an internally threaded portion 85 of a sleeve base 84, so that the first and second housing sections 72, 73 are held between the sleeve base 84 and the cage 80. A vacuum tube 33 included in an amplifier of the acoustic/electric converting system of the microphone apparatus is mounted on a socket 34 that is mounted on the side chassis 43 and 44 through a cushion member 88 and a socket support member 89.

The cylindrical microphone apparatus 61 is adapted to absorb vibrations in the air gap formed where the first and second housing sections 72 and 73 are connected so as to minimize the vibrations transmitted to the microphone capsule 62. By connecting the first and second housing sections 72 and 73 through the thin portions 75 and 77, it is possible to decrease the resonance frequency $f_0$ of the housing 32 and to decrease the vibration losses. This is effective to minimize the level of the vibrations on the housing.

Although the housing 32 is divided into two housing sections 72 and 73, it is to be noted that the housing 32 may be divided into three or more housing sections. The vibration damping effect increases as the number of housing sections into which the housing 32 is divided increases. It is to be understood that the shape of the housing 32 is not limited in any way to the cylindrical shape and may be made in other forms.

While the invention has been described in conjunction with specific embodiments thereof, it is evident that many alternatives, modifications and variations will be apparent to those skilled in the art. Accordingly, it is intended to embrace all alternatives, modifications and variations that fall within the scope of the appended claims.

What is claimed is:

1. A microphone apparatus comprising:

a main housing;

means for converting a sound signal to an electric signal disposed in said main housing;

a vacuum-tube housing connected to said main housing;

a vacuum-tube amplifier disposed in said vacuum-tube housing mounted on said main housing and connected to said means for converting for amplifying said electric signal;

a thermo-ionic cooling element for absorbing heat generated by said vacuum-tube amplifier and having a first surface for absorbing said heat and a second surface for radiating said heat, said first surface receiving heat from said vacuum-tube amplifier through contact with said vacuum-tube housing;

a heat conducting device in contact with said second surface of said thermo-ionic cooling element for conducting said heat radiated by said second surface of said cooling element;

means for absorbing condensation on an outer surface of said vacuum-tube housing, said means for absorbing being wrapped around said outer surface of said vacuum-tube housing; and fins mounted on said heat conducting device for radiating said heat.

2. A microphone apparatus according to claim 1, wherein said thermo-ionic cooling element is a Peltier element.

3. A microphone apparatus comprising:

a main housing;

means for converting a sound signal to an electric signal disposed in said main housing;

a vacuum-tube housing connected to said main housing;

a vacuum-tube amplifier disposed in said vacuum-tube housing mounted on said main housing and connected to said means for converting for amplifying said electric signal;

a thermo-ionic cooling element for absorbing heat generated by said vacuum-tube amplifier and having a first surface for absorbing said heat and a second surface for radiating said heat, said first surface receiving heat from said vacuum-tube amplifier through contact with said vacuum-tube housing; and means for absorbing condensation on an outer surface of said vacuum-tube housing, said means for absorbing being wrapped around said outer surface of said vacuum-tube housing.

4. The microphone apparatus according to claim 3, wherein said thermo-ionic cooling element is a Peltier element.

5. A microphone apparatus comprising:

a main housing;

means for converting a sound signal to an electric signal disposed in said main housing;

a vacuum-tube housing connected to said main housing;

a vacuum-tube amplifier disposed in said vacuum-tube housing mounted on said main housing and connected to said means for converting for amplifying said electric signal;

a thermo-ionic cooling element for absorbing heat generated by said vacuum-tube amplifier and having a first surface for absorbing said heat and a second surface for radiating said heat, said first surface receiving heat from said vacuum-tube amplifier through contact with said vacuum-tube housing;

means for absorbing condensation on an outer surface of said vacuum-tube housing, said means for absorbing being wrapped around said outer surface of said vacuum-tube housing; and fins in contact with said second surface of said thermo-ionic cooling element for radiating said heat radiated by said second surface.

6. The microphone apparatus according to claim 5, wherein said thermo-ionic cooling element is a Peltier element.

7. A microphone apparatus comprising:

a first housing containing a device for converting a sound signal to an electric signal;

a second housing containing a vacuum-tube amplifier for amplifying said electric signal;

a thermo-ionic cooling element for absorbing heat generated by said vacuum-tube amplifiers and having a first surface for absorbing said heat and a .;second surface for radiating said heat, said first surface being in contact with said vacuum-tube amplifier and said first and second housings being engaged with each other;

a heat conducting device in contact with said second surface of said thermo-ionic cooling element for conducting said heat radiated by said second surface;

fins mounted on said heat conducting device for radiating said heat; and means for absorbing condensation on an outer surface of said second housing, said means for absorbing being wrapped around said outer surface of Said second housing.

8. The microphone apparatus according to claim 7, wherein said means for absorbing includes a portion for evaporating condensation absorbed thereby.

9. The microphone apparatus according to claim 7, wherein said means for absorbing comprises a fibrous material.

10. The microphone apparatus according to claim 7, wherein said thermo-ionic cooling element is composed of a Peltier element.

11. A microphone apparatus comprising:

a housing containing a device for converting a sound signal to an electric signal;

a vacuum-tube amplifier mounted on said housing and connected to said device for converting for amplifying said electric signal; and a heat conductive, resilient holding device in contact with an inner surface of said housing for contacting substantially the entire outer surface of said vacuum-tube amplifier and holding said vacuum-tube amplifier at a distance from said inner surface, said holding device absorbing heat generated by said vacuum-tube amplifier and conducting said heat to said housing and radiating said heat from said housing.

* * * * *

UNITED STATES PATENT AND TRADEMARK OFFICE

CERTIFICATE OF CORRECTION

PATENT NO. : 5,357,577

DATED : October 18, 1994

INVENTOR(S) : Tomohiro Waji, et al. and Eiichi Tanaka

It is certified that error appears in the above-indentified patent and that said Letters Patent is hereby corrected as shown below:

Col. 3, line 11, after "or" delete ":"
line 56, change ";" to --7,--
Col. 6, line 31, delete "=!"
line 39, change "Windscreen" to --windscreen--

In the claims:

Col. 10, line 6, change "amplifiers" to --amplifier--
line 8, delete ".;"
line 20, change "Said" to --said--

Signed and Sealed this

Thirteenth Day of June, 1995

*Attest:*

Bruce Lehman

BRUCE LEHMAN

*Attesting Officer*

*Commissioner of Patents and Trademarks*